US007140198B2

(12) United States Patent
Matsuoka et al.

(10) Patent No.: US 7,140,198 B2
(45) Date of Patent: Nov. 28, 2006

(54) AIR CONDITIONER

(75) Inventors: Shinya Matsuoka, Sakai (JP); Yasushi Hori, Sakai (JP); Shinri Sada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 325 days.

(21) Appl. No.: 10/503,214

(22) PCT Filed: Nov. 17, 2003

(86) PCT No.: PCT/JP03/14601

§ 371 (c)(1),
(2), (4) Date: Aug. 3, 2004

(87) PCT Pub. No.: WO2004/048863

PCT Pub. Date: Jun. 10, 2004

(65) Prior Publication Data

US 2005/0103045 A1 May 19, 2005

(30) Foreign Application Priority Data

Nov. 22, 2002 (JP) ..... 2002-339697

(51) Int. Cl.
*F25B 1/00* (2006.01)

(52) U.S. Cl. ..... 62/498; 62/193; 62/510

(58) Field of Classification Search ..... 62/193, 62/228.5, 324.1, 470, 498, 510
See application file for complete search history.

(56) References Cited

U.S. PATENT DOCUMENTS 4,055,963 A * 11/1977 Shoji et al. ..... 62/238.6
5,265,443 A * 11/1993 Yuzawa et al. ..... 62/498
5,768,903 A * 6/1998 Sekigami et al. ..... 62/196.2
5,894,735 A * 4/1999 Misawa et al. ..... 62/177
5,996,363 A * 12/1999 Kurachi et al. ..... 62/192
6,237,358 B1 * 5/2001 Kondo et al. ..... 62/335

FOREIGN PATENT DOCUMENTS

| | | |
|---|---|---|
| JP | 4-324069 A | 11/1992 |
| JP | 05-288422 A | 11/1993 |
| JP | 6-249527 A | 9/1994 |
| JP | 10-238879 A | 9/1998 |
| JP | 10-281578 A | 10/1998 |
| JP | 2002-195705 A | 7/2002 |

* cited by examiner

*Primary Examiner*—Melvin Jones
(74) *Attorney, Agent, or Firm*—Global IP Counselors

(57) ABSTRACT

The present invention is capable of eliminating the line unit in an air conditioner that includes a plurality of heat source units, and hold increases in onsite line construction to a minimum while making it possible to adjust the amount of refrigerant in the air conditioner. The air conditioner includes a plurality of heat source units, a refrigerant liquid junction line and a refrigerant gas junction line, user units, and a refrigerant supply circuit. The refrigerant supply circuit is used in situations in which some of the plurality of heat source units stop operating in response to the operational burden of the user units, and is formed from refrigerant removal lines that remove refrigerant that accumulates inside stopped heat source units to the exterior thereof, and an oil equalization line and oil removal lines that connect the refrigerant removal lines of each stopped heat source unit and the intake sides of the compression mechanisms of the operating heat source units.

10 Claims, 9 Drawing Sheets

AIR CONDITIONER

TECHNICAL FIELD

The present invention relates to an air conditioner, and more particularly to an air conditioner having a plurality of heat source units.

BACKGROUND ART

In some conventional air conditioners having a plurality of heat source units, heat source side branch liquid lines and heat source side branch gas lines of the plurality of heat source units are connected to a separately provided line unit, and the heat source side branch liquid lines and the heat source side branch gas lines are merged together inside the line unit as a refrigerant liquid junction line and a refrigerant gas junction line and connected to user units.

This line unit not only functions to integrate the aforementioned heat source side branch liquid lines and the heat source side branch gas lines into a refrigerant liquid junction line and a refrigerant gas junction line, but when some of the plurality of heat source units stop operating in response to the operational burden of the user units, the line unit also functions to accumulate refrigerant inside the stopped heat source units to prevent a shortage in the refrigerant that flows between the user units and the operating heat source units.

With this type of air conditioner, the heat source side branch liquid lines and the heat source side branch gas lines of each heat source unit can be merged together into a refrigerant liquid junction line and a refrigerant gas junction line by simply connecting the heat source side branch liquid lines and the heat source side branch gas lines to the line unit, and thus the ability to construct the air conditioner at the location in which it is to be installed can be improved (see, for example, Japanese Published Unexamined Patent Application No. H06-249527).

However, from a manufacturing viewpoint, the line unit of the aforementioned conventional air conditioner must be manufactured and stored as inventory, and thus causes costs to increase. Thus, there is a need to eliminate the line unit when seen from the perspective of manufacturing these units.

SUMMARY OF THE INVENTION

An object of the present invention is to eliminate the line unit in an air conditioner that includes a plurality of heat source units, and hold increases in onsite line construction to a minimum while making it possible to adjust the amount of refrigerant in the air conditioner.

According to a first aspect of the present invention, an air conditioner includes a plurality of heat source units, a refrigerant liquid junction line and a refrigerant gas junction line, user units, and a refrigerant supply circuit. The heat source units each include a compression mechanism and a heat source side heat exchanger. The refrigerant liquid junction line and the refrigerant gas junction line parallel connect each heat source unit. The user units each include a user side heat exchanger, and are connected to the refrigerant liquid junction line and the refrigerant gas junction line. The refrigerant supply circuit is used in situations in which some of the heat source units have stopped operating in response to the operational burden of the user units, and includes a refrigerant removal line provided in each heat source unit that serves to remove to the exterior of the stopped heat source units the refrigerant that accumulates in the interior of the heat source units, and a communication line that connects the refrigerant removal lines and the intake side of the compression mechanisms of the operating heat source units.

In this air conditioner, equipment control is performed in which, for example, some of the plurality of the heat source units are stopped in response to the operational burden of the user units. Thus, during cooling operations, refrigerant gas discharged from the compression mechanisms in the operating heat source units is condensed by the heat source side heat exchangers into refrigerant liquid and merged into the refrigerant liquid junction line, the refrigerant liquid is evaporated into refrigerant gas by the user side heat exchangers of the user units, and the refrigerant gas is drawn into the compression mechanisms of the operating heat source units via the refrigerant gas junction line. In addition, during heating operations, refrigerant gas discharged from the compression mechanisms is merged together in the refrigerant gas junction line, the refrigerant gas is condensed by the user side heat exchangers of the user units into refrigerant liquid, the refrigerant liquid is sent to the operating heat source units via the refrigerant liquid junction line, the refrigerant liquid is evaporated into refrigerant gas by the heat source side heat exchangers, and the refrigerant gas is drawn into the compression mechanisms of the operating heat source units. On the other hand, the refrigerant supply circuit is employed to supply refrigerant accumulated inside the stopped heat source units to the intake sides of the compression mechanisms of the operating heat source units, so that there will be no shortage of refrigerant flowing between the user units and the operating heat source units.

Here, the refrigerant supply circuit includes the refrigerant removal lines that remove to the exterior of the heat source units refrigerant that accumulates in the interior of the heat source units, and a communication line that connects the refrigerant removal lines and the intake sides of the compression mechanisms of the operating heat source units. In other words, a function that adjusts the quantity of refrigerant so that there are no shortages thereof is achieved in this air conditioner by simply providing essential components that form the refrigerant supply circuit in the interior of the heat source units, and providing a communication line between the heat source units. This allows the line unit provided in the prior art to be eliminated, and allows increases in onsite line construction to be held to a minimum while preventing refrigerant shortages.

According to a second aspect of the present invention, the air conditioner of the first aspect of the present invention is provided, in which the heat source side heat exchangers are connected to the discharge sides of the compression mechanisms. Each heat source unit further includes a heat source side branch liquid line that is connected to the liquid side of the heat source side heat exchanger and the refrigerant liquid junction line, a receiver that is provided on the heat source side branch liquid line, and a heat source side branch gas line that is connected to the intake side of the compression mechanism and the refrigerant gas junction line. Each refrigerant removal line is arranged such that it removes refrigerant from between the discharge side of the compression mechanism and the gas side of the heat source side heat exchanger.

During cooling operations with this air conditioner, because a refrigerant removal line is provided between the discharge sides of each compression mechanism and the gas sides of each heat source side heat exchanger, the portion of the accumulated refrigerant inside each stopped heat source unit that exists from the discharge side of the compression mechanism to the heat source side branch liquid line (including the receiver) will be supplied to the operating heat source units via the refrigerant removal line. At this point, the refrigerant liquid accumulated inside the receiver is evaporated by the heat source side heat exchanger, and then supplied to the operating heat source units via the refrigerant removal line.

According to a third aspect of the present invention, the air conditioner of the second aspect is provided, in which each heat source side branch liquid line includes a refrigerant open/close mechanism that closes so that refrigerant will not flow from the refrigerant liquid junction line to the interior of a stopped heat source unit when refrigerant accumulated inside the stopped heat source unit is to be removed to the exterior thereof via the refrigerant removal line.

In this air conditioner, refrigerant accumulated in a stopped heat source unit can be removed to the exterior of the heat source unit with good efficiency by means of the refrigerant open/close mechanism, because the refrigerant open/close mechanism can be closed so that refrigerant will not flow from the refrigerant line junction line to the interior of the stopped heat source unit.

According to a fourth aspect of the present invention, the air conditioner of the third aspect of the present invention is provided, in which the refrigerant open/close mechanism can make refrigerant liquid that flows in the refrigerant liquid junction line flow into the interior of a stopped heat source unit when the quantity of refrigerant that flows between the user units and the operating heat source units reaches an excessive state.

In this air conditioner, when the quantity of refrigerant that flows between the user units and the operating heat source units reaches an excessive state, the quantity of refrigerant in the operating heat source units can be reduced by operating the refrigerant open/close mechanism to make refrigerant that flows in the refrigerant liquid junction line flow into a stopped heat source unit and accumulate in the receiver thereof. This allows the quantity of refrigerant in the air conditioner to be adjusted.

According to a fifth aspect of the present invention, the air conditioner of the first aspect of the present invention is provided, in which the heat source side heat exchangers are connected to the intake sides of the compressor mechanisms. Each heat source unit further includes a heat source side branch liquid line that is connected to the liquid side of the heat source side heat exchanger and the refrigerant liquid junction line, a heat source side branch gas line that is connected to the discharge side of the compression mechanism and the refrigerant gas junction line, and a receiver that is provided on the heat source side branch liquid line. The refrigerant removal line is arranged such that it removes refrigerant from between the intake side of the compression mechanism and the gas side of the heat source side heat exchanger.

During heating operations with this air conditioner, because the refrigerant removal line is provided between the intake side of the compression mechanism and the gas side of the heat source side heat exchanger, the portion of the accumulated refrigerant inside a stopped heat source unit that exists from the intake side of the compression mechanism to the heat source side branch liquid line (including the receiver) will be supplied to the operating heat source units via the refrigerant removal line. At this point, the refrigerant liquid accumulated inside the receiver is evaporated by the heat source side heat exchanger, and then supplied to the operating heat source units via the refrigerant removal line.

According to a sixth aspect of the present invention, the air conditioner of the fifth aspect of the present invention is provided, in which each heat source side branch liquid line includes a refrigerant open/close mechanism that closes so that refrigerant will not flow from the refrigerant liquid junction line to the interior of a stopped heat source unit when refrigerant accumulated inside the stopped heat source units is to be removed to the exterior of the heat source units via the refrigerant removal line.

In this air conditioner, because the refrigerant open/close mechanism can be closed so that refrigerant will not flow from the refrigerant liquid junction line to the interior of a stopped heat source unit, refrigerant accumulated in the stopped heat source unit can be removed to the exterior of the heat source unit with good efficiency by means of the refrigerant open/close mechanism.

According to a seventh aspect of the present invention, the air conditioner of the sixth aspect of the present invention is provided, in which a stopped heat source unit further includes a receiver pressurization circuit that makes some of the refrigerant that flows in the refrigerant gas junction line flow into the receiver via the heat source side branch gas line.

In this air conditioner, the refrigerant liquid accumulated in the receiver can be discharged to the heat source side branch liquid line with the refrigerant open/close mechanism in the closed state because the receiver can be pressurized by means of the receiver pressurization circuit.

According to an eighth aspect of the present invention, the air conditioner of the sixth or seventh aspects of the present invention is provided, in which the refrigerant open/close mechanism can make refrigerant liquid that flows in the refrigerant liquid junction line to flow into the interior of a stopped heat source unit when the quantity of refrigerant that flows between the user units and the operating heat source units reaches an excessive state.

In this air conditioner, when the quantity of refrigerant that flows between the user units and the operating heat source units reaches an excessive state, the quantity of refrigerant that flows between the user units and the operating heat source units can be reduced by operating a refrigerant open/close mechanism to make refrigerant that flows in the refrigerant liquid junction line flow into a stopped heat source unit and accumulate in the receiver thereof. This allows the quantity of refrigerant in the air conditioner to be adjusted.

According to a ninth aspect of the present invention, the air conditioner of any one of the first to eighth aspects of the present invention is provided, in which the communication line is an oil equalization line that equally distributes oil between the compression mechanisms of each heat source unit.

With this air conditioner, onsite line construction can be further reduced because the junction line also serves as an oil equalization line.

According to a tenth aspect of the present invention, an air conditioner includes a plurality of heat source units, a refrigerant liquid junction line and a refrigerant gas junction line, user units, and receiver depressurization circuits. Each heat source unit includes a compression mechanism, a heat source side heat exchanger that is connected to the intake side of the compression mechanism, and a receiver that is connected to the liquid side of the heat source side heat exchanger. The refrigerant liquid junction line and the refrigerant gas junction line parallel connect each heat source unit. Each user unit includes a user side heat exchanger, and is connected to the refrigerant liquid junction line and the refrigerant gas junction line. The receiver depressurization circuits make refrigerant flow out from the receivers of the heat source units that have a shortage of refrigerant to the intake sides of the compression mechanisms.

In this air conditioner, refrigerant gas discharged from the compressor mechanisms is merged together in the refrigerant gas junction line, the refrigerant gas is condensed by the user side heat exchangers of the user units into refrigerant liquid, the refrigerant liquid is sent to the operating heat source units via the refrigerant liquid junction line, the refrigerant liquid is evaporated into refrigerant gas by the heat source side heat exchangers, and the refrigerant gas is drawn into the compressor mechanisms of the operating heat source units.

Here, refrigerant liquid will be unequally distributed to each heat source unit in situations in which all of the heat source units are operating and the refrigerant that flows in the refrigerant liquid junction line is in the gas-liquid phase. In this type of situation, the quantity of refrigerant liquid to be supplied to certain heat source units will be reduced, and a refrigerant shortage will be created.

However, in this air conditioner, because heat source unit includes the receiver depressurization circuits, the quantity of refrigerant that will flow from the refrigerant liquid junction line into the heat source units in which there is a refrigerant shortage can be increased by making refrigerant flow from the receivers of the heat source units in which there is a shortage of refrigerant to the intake sides of the compressor mechanisms thereof. This allows refrigerant shortages to be eliminated, and allows the quantity of refrigerant to be sent from the refrigerant liquid junction line to each heat source unit to be maintained at an appropriate flow rate balance. This allows the line unit provided in the prior art to be eliminated, and allows increases in onsite line construction to be held to a minimum while preventing refrigerant shortages.

BRIEF DESCRIPTIONS OF THE DRAWINGS

PREFERRED EMBODIMENT OF THE INVENTION

An air conditioner according an embodiment of the present invention will be described below with reference to the figures.

(1) Overall Configuration of the Air Conditioner

Figure 1:
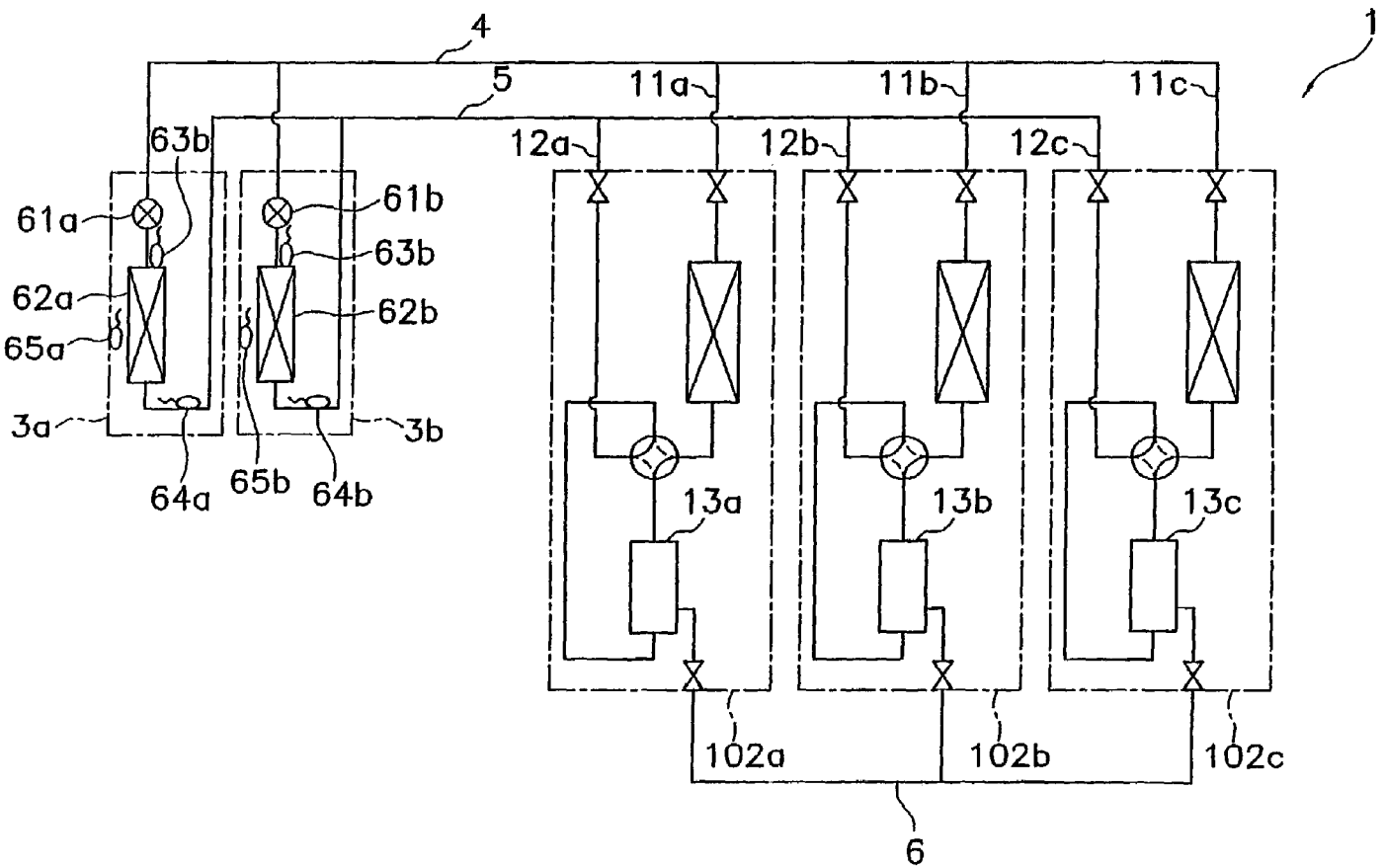
FIG. 1 is a block diagram showing the configuration of an air conditioner according to an embodiment of the present invention.

FIG. 1 is a block diagram showing the configuration of an air conditioner according to an embodiment of the present invention. An air conditioner 1 includes first, second, and third heat source units 102*a*–102*c* (three units in the present embodiment), a refrigerant liquid junction line 4 and a refrigerant gas junction line 5 that serve to serially connect the heat source units 102*a*–102*c*, and a plurality of user units 3*a*, 3*b* (2 units in this embodiment) that are parallel connected to the refrigerant liquid junction line 4 and the refrigerant gas junction line 5. More specifically, heat source side branch liquid lines 11*a*–11*c* of the heat source units 102*a*–102*c* are respectively connected to the refrigerant liquid junction line 4, and the heat source side branch gas lines 12*a*–12*c* of the heat source units 102*a*–102*c* are respectively connected to the refrigerant gas junction line 5.

In addition, the heat source units 102*a*–102*c* include compression mechanisms 13*a*–13*c* that include one or more compressors. An oil equalization line 6 is provided between these compression mechanisms 13*a*–13*c*, and allows oil to be exchanged between the heat source units 102*a*–102*c*.

This air conditioner can increase or decrease the number of heat source units 102*a*–102*c* in operation in response to the operational burden of the user units 3*a*, 3*b*.

(2) Configuration of the User Units

Next, the user units 3*a*, 3*b* will be described. Note that because the configurations of the user unit 3*a* and the user unit 3*b* are the same, only details regarding the user unit 3*a* will be disclosed, and a description of the user unit 3*b* will be omitted.

The user unit 3*a* primarily includes a user side expansion valve 61*a*, a user side heat exchanger 62*a*, and a line that that connects these. In the present embodiment, the user side expansion valve 61*a* is an electric expansion valve that is connected to the liquid side of the user side heat exchanger 62*a*, and serves to adjust the refrigerant flow rate and the like. In the present embodiment, the user side heat exchanger 62*a* is a cross fin tube type of heat exchanger, and serves to exchange heat with indoor air. In the present embodiment, the user unit 3*a* takes in indoor air into the interior thereof, includes an indoor fan for blowing (not shown in the figures), and is capable of exchanging heat between the indoor air and the refrigerant that flows in the user side heat exchanger 62*a*.

In addition, various sensors are provided in the user unit 3*a*. A liquid side temperature sensor 63*a* that detects the refrigerant liquid temperature is arranged on the liquid side of the user side heat exchanger 62*a*, and a gas side temperature sensor 64*a* that detects the refrigerant gas temperature is arranged on the gas side of the user side heat exchanger 62*a*. Furthermore, a room temperature sensor 65*a* that detects the temperature of indoor air is provided in the user unit 3*a*.

(3) Configuration of the Heat Source Units

Figure 2:
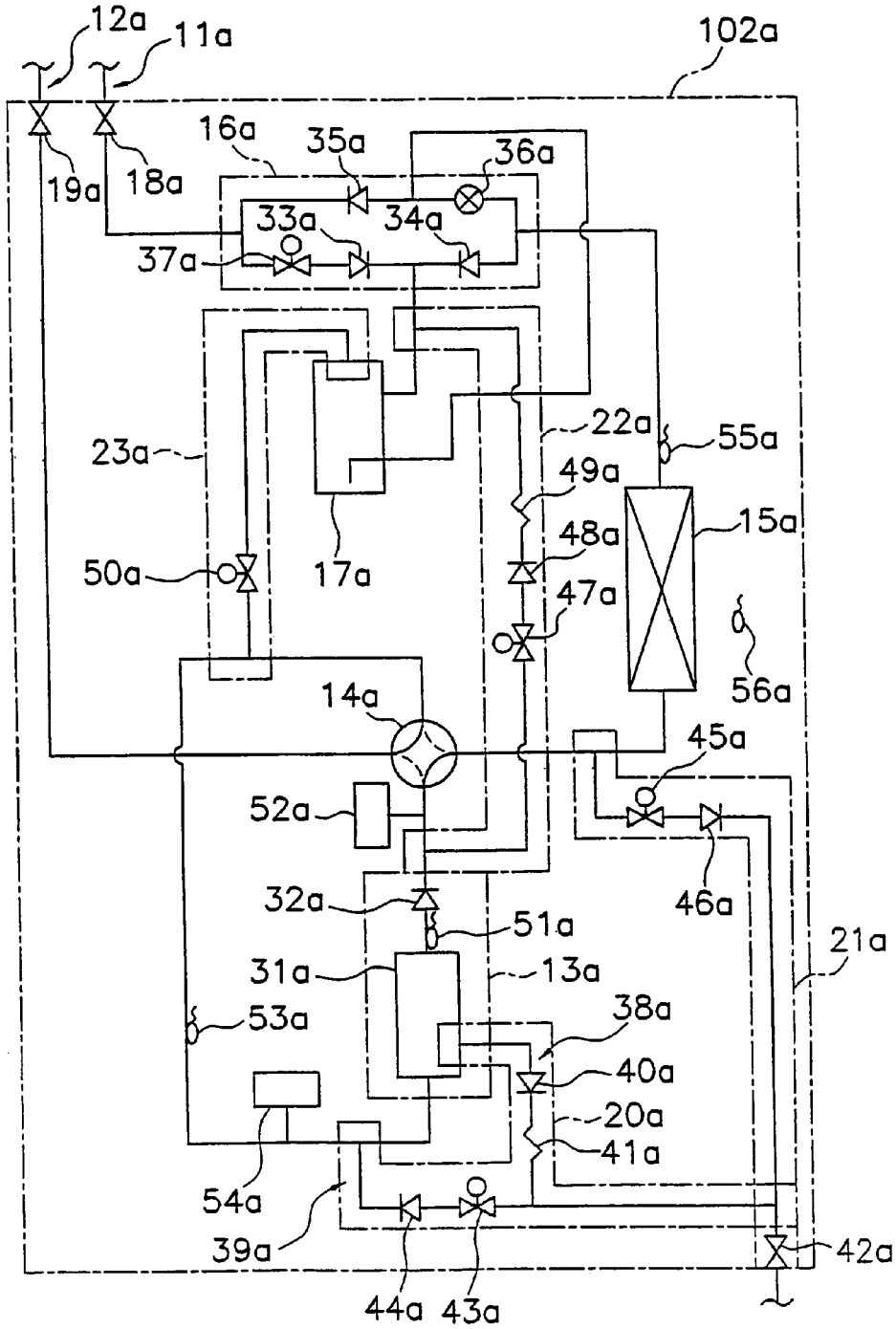
FIG. 2 is an outline of a refrigerant circuit of a heat source unit of an air conditioner according to the present invention.

Next, the first, second and third heat source units 102*a*–102*c* will be described with reference to FIG. 2. Here, FIG. 2 shows an outline of a refrigerant circuit of the first heat source unit 102*a*. Note that in the description below, only the details of the first heat source unit 102*a* will be disclosed, and a description of the second and third heat source units 102*b*, 102*c* will be omitted because the first heat source unit 102*a* has the same configuration as the second and third heat source units 102*b*, 102*c*.

The heat source unit 102*a* primarily includes a compression mechanism 13*a*, a four way switching valve 14*a*, a heat source side heat exchanger 15*a*, a bridge circuit 16*a*, a receiver 17*a*, a liquid side gate valve 18*a*, a gas side gate valve 19*a*, an oil removal line 20*a*, a refrigerant removal line 21*a*, a receiver pressurization circuit 22*a*, a receiver depressurization circuit 23*a*, and a line that connects these.

The compression mechanism 13*a* primarily includes a compressor 31*a*, an oil separator (not shown in the figures), and a check valve 32*a* that is provided on the discharge side of the compressor 31*a*. In the present embodiment, the compressor 31*a* is an electric motor driven scroll type compressor, and serves to compress refrigerant gas that has been drawn therein.

When switching between cooling operations and heating operations, the four way switching valve 14*a* serves to switch the direction of the refrigerant flow. During cooling operations, the four way switching valve 14*a* connects the discharge side of the compression mechanism 13*a* and the gas side of the heat source side heat exchanger 15*a*, and connects the intake side of the compression mechanism 13*a* and the heat source side branch gas line 12*a* (refer to the solid line of the four way switching valve 14*a* in FIG. 2). During heating operations, the four way switching valve 14*a* connects the discharge side of the compression mechanism 13*a* and the heat source side branch liquid line 11*a*, and connects the intake side of the compression mechanism 13*a* and the gas side of the heat source side heat exchanger 15*a* (refer to the broken line of the four way switching valve 14*a* in FIG. 2).

In the present embodiment, the heat source side heat exchanger 15*a* is a cross fin tube type of heat exchanger, and serves to exchange heat between air and refrigerant that acts as a heat source. In the present embodiment, the heat source unit 102*a* takes in outdoor air into the interior thereof, includes an outdoor fan for blowing (not shown in the figures), and is capable of exchanging heat between the outdoor air and the refrigerant that flows in the heat source side heat exchanger 15*a*.

The receiver 17*a* is a vessel that serves to temporarily accumulate refrigerant that flows between the heat source side heat exchanger 15*a* and the user side heat exchangers 62*a*, 62*b* of the user units 3*a*, 3*b*. The receiver 17*a* includes an intake port on the upper portion of the vessel, and a discharge port on the lower portion of the vessel. The intake port and the discharge port of the receiver 17*a* are respectively connected to the heat source side branch liquid line 11*a* via the bridge circuit 16*a*.

The bridge circuit 16*a* includes three check valves 33*a*–35*a* that are connected to the heat source side branch liquid line 11*a*, a heat source side expansion valve 36*a*, and a first open/close mechanism 37*a*. The bridge circuit 16*a* functions to make refrigerant flow from the intake port side of the receiver 17*a* into the receiver 17*a*, as well as return refrigerant liquid from the discharge port of the receiver 17*a* to the heat source side branch liquid line 11*a*, either when refrigerant that flows in the refrigerant circuit between the heat source side heat exchanger 15*a* and the user side heat exchangers 62*a*, 62*b* flows from the heat source side heat exchanger 15*a* to the receiver 17*a*, or when refrigerant that flows in the refrigerant circuit between the heat source side heat exchanger 15*a* and the user side heat exchangers 62*a*, 62*b* flows from the user side heat exchangers 62*a*, 62*b* to the receiver 17*a*. More specifically, the check valve 33*a* is connected such that refrigerant that flows in the direction from the user side heat exchangers 62*a*, 62*b* to the heat source side heat exchanger 15*a* is guided to the intake port of the receiver 17*a*. The check valve 34*a* is connected such that refrigerant that flows in the direction from the heat source side heat exchangers 15*a* to the user side heat exchangers 62*a*, 62*b* is guided to the intake port of the receiver 17*a*. The check valve 35*a* is connected such that refrigerant can flow from the discharge port of the receiver 17*a* to the user side heat exchangers 62*a*, 62*b*. The heat source side expansion valve 36*a* is connected such that refrigerant can flow from the discharge port of the receiver 17*a* to the heat source side heat exchanger 15*a*. In addition, in the present embodiment, the heat source side expansion valve 36*a* is an electric expansion valve that serves to adjust the refrigerant flow rate between the heat source side heat exchanger 15*a* and the user side heat exchangers 62*a*, 62*b*. The first open/close mechanism 37*a* is arranged so that it can allow or prevent the refrigerant to flow from the liquid side gate valve 18*a* toward the receiver 17*a*. In the present embodiment, the first open/close mechanism 37*a* is a solenoid valve that is arranged on the liquid side gate valve 18*a* side of the check valve 33*a*. In this way, the refrigerant that flows from the heat source side branch liquid line 11*a* into the receiver 17*a* will always flow therein from the intake port of the receiver 17*a*, and the refrigerant from the discharge port of the receiver 17*a* will always be returned to the heat source side branch liquid line 11*a*.

The oil removal line 20*a* is an oil line that serves to exchange oil between the compression mechanism 13*a* and the second heat source unit 102*b* and the third heat source unit 102*c*, and includes an oil discharge line 38*a* that discharges oil to the exterior of the compressor 31*a* when the quantity of oil in an oil accumulation portion of the compressor 31*a* exceeds a predetermined quantity, and an oil return line 39*a* that is branched from the oil discharge line 38*a* and which can return oil to the intake side of the compression mechanism 13*a*. The oil discharge line 38*a* is formed from a check valve 40*a*, a capillary 41*a*, an oil gate valve 42*a*, and an oil line that connects these. The oil return line 39*a* is formed from an oil return valve 43*a* that is a solenoid valve, a check valve 44*a*, and an oil line that connects these. Then, an oil equalization circuit that serves to exchange the oil of the compression mechanisms of each heat source unit 102*a*–102*c* is formed by the oil removal line 20*a* and the oil equalization line 6 that serves to connect the compression mechanisms of the heat source units 102*a*–102*c*.

The refrigerant removal line 21*a* is a refrigerant line that is arranged such that refrigerant from between the four way switching valve 14*a* and the heat source side heat exchanger 15*a* can be removed to the exterior of the heat source unit, and includes a second open/close mechanism 45*a* that is a solenoid valve, a check valve 46*a*, and a refrigerant line that connects these. In the present embodiment, the refrigerant removal line 21*a* is connected to the oil removal line 20*a*, and refrigerant is removed to the exterior of the heat source unit via the oil equalization line 6 that serves to connect the compression mechanisms of each heat source unit 102*a*–102*c*. In other words, a refrigerant supply circuit that serves to exchange refrigerant between each heat source unit 102a–102c is formed by the refrigerant removal line 21a, the oil removal line 20a, and the oil equalization line 6.

The receiver pressurization circuit 22a is a refrigerant line that is arranged such that refrigerant from between the discharge side of the compression mechanism 13a and the four way switching valve 14a can be sent directly to the intake port of the receiver 17a, and includes a third open/closed mechanism 47a that is a solenoid valve, a check valve 48a, a capillary 49a, and a refrigerant line that connects these.

The receiver depressurization circuit 23a is a refrigerant line that is arranged such that refrigerant from the upper portion of the receiver 17a can flow to the intake side of the compression mechanism 13a, and includes a fourth open/close valve 50a that is a solenoid valve, and a refrigerant line that connects these.

In addition, various sensors are provided in the heat source unit 102a. Specifically, a discharge temperature sensor 51a that detects the discharge refrigerant temperature of the compression mechanism 13a and a discharge pressure sensor 52a are provided on the discharge side of the compression mechanism 13a. An intake temperature sensor 53a that detects the intake refrigerant temperature of the compression mechanism 13a and an intake pressure sensor 54a are provided on the intake side of the compression mechanism 13a. A heat exchange temperature sensor 55a that detects refrigerant temperature is provided on the liquid side of the heat source side heat exchanger 15a. An outside air temperature sensor 56a that detects the temperature of the outside air is provided near the heat source side heat exchanger 15a. Then, the apertures of the user side expansion valves 61a, 61b and the heat source side expansion valve 36a (heat source side expansion valves 36b, 36c in the case of the heat source units 102b, 102c) and the capacity of the compression mechanism 13a (the compression mechanisms 13b, 13c in the case of the heat source units 102b, 102c) are controlled based upon the detection signals of the various sensors provided in the user units 3a, 3b.

Figure 9:
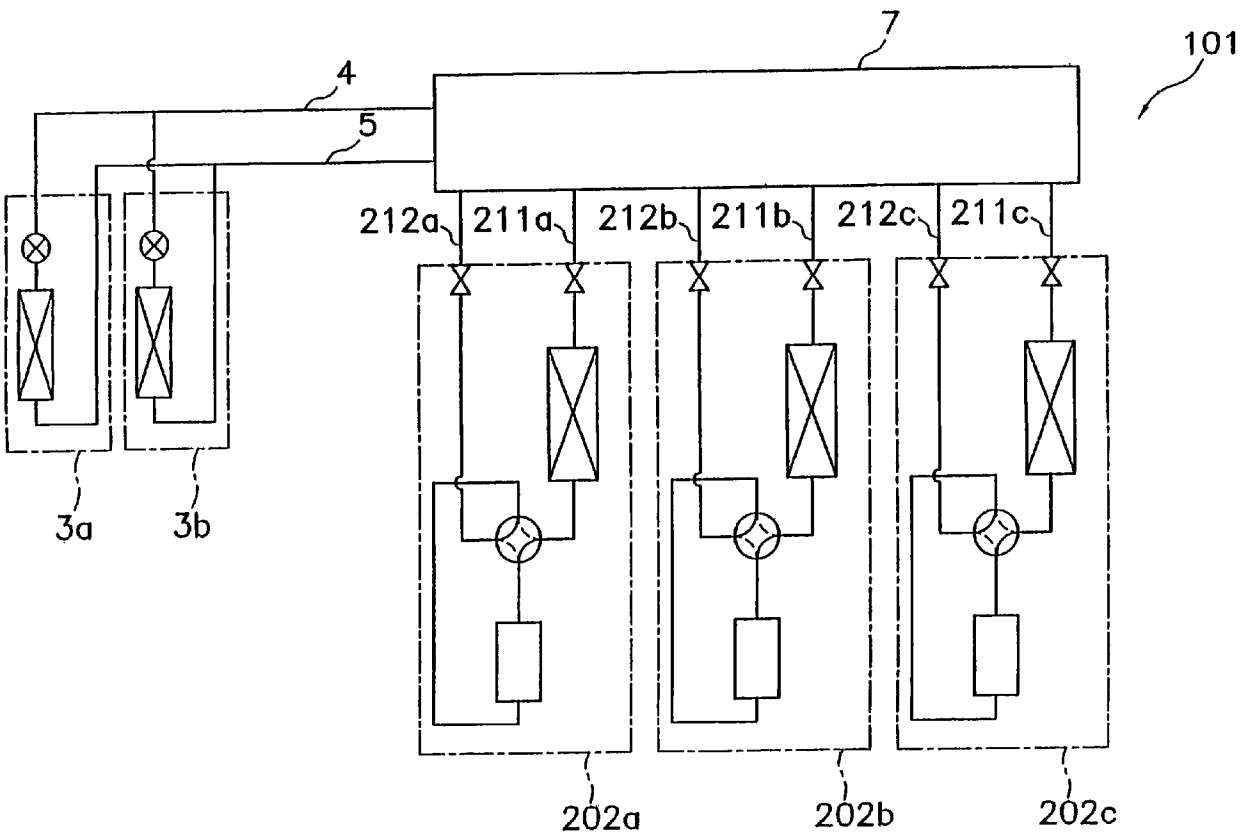
FIG. 9 is a block diagram showing the configuration of a conventional air conditioner.

Thus, with the air conditioner 1, although it will be necessary to directly connect the heat source side branch liquid lines 11a–11c and the heat source side branch gas lines 12a–12c to the refrigerant liquid junction line 4 and the refrigerant gas junction line 5, as well as connect a communication line (which also serves as the oil equalization line 6 in the present embodiment) in order to exchange refrigerant between the heat source units, compared to a conventional configuration shown in FIG. 9 in which heat source side branch liquid lines 211a–211c and heat source side branch gas lines 212a–212c of heat source units 202a–202c are connected to the refrigerant liquid junction line 4 and the refrigerant gas junction line 5 via a line unit 7, the merit that is obtained by the present invention is that the line unit 7 can be eliminated.

(4) Operation of the Air Conditioner

Figure 3:
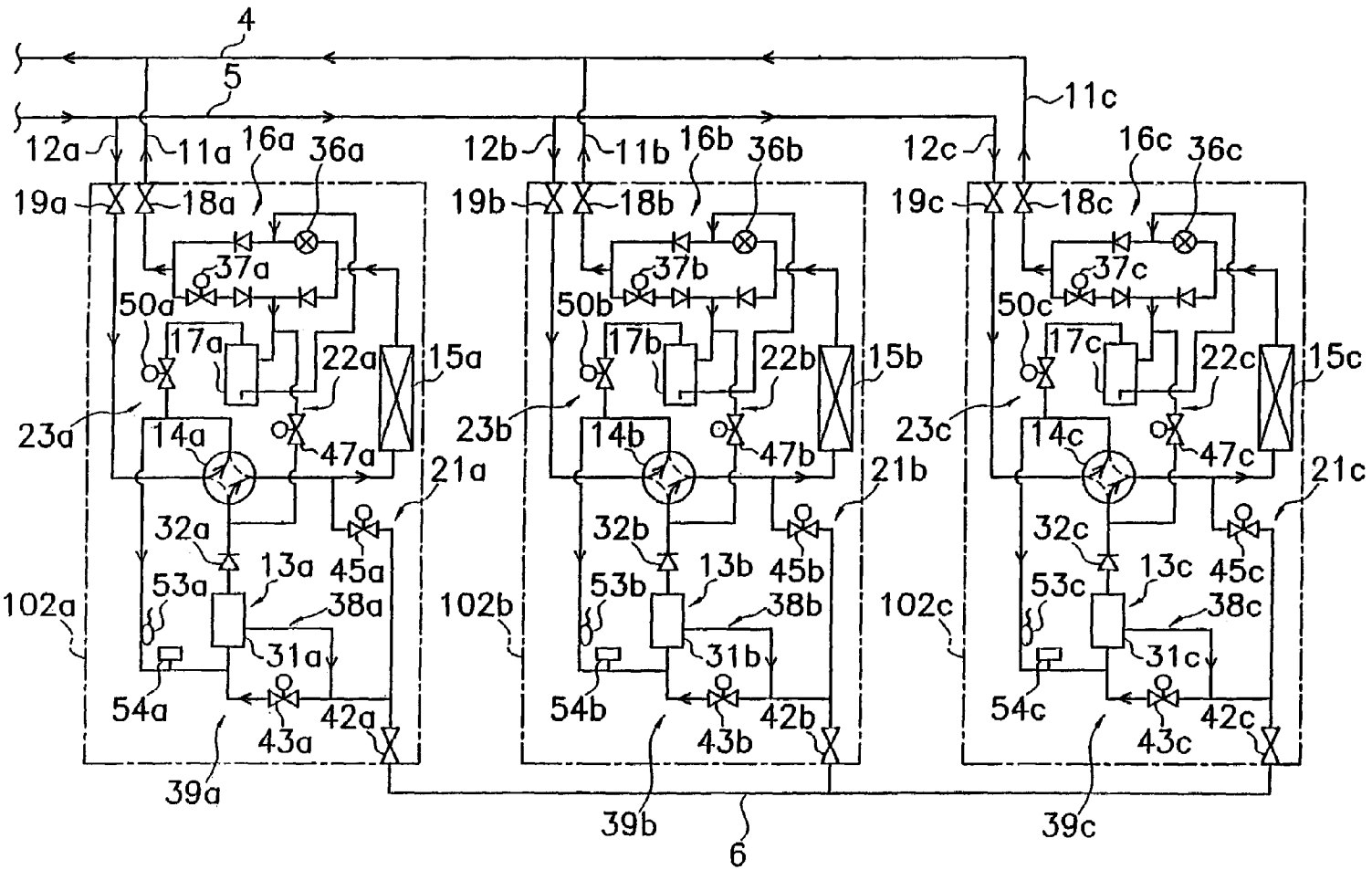
FIG. 3 is an outline of the refrigerant circuits of heat source units when all the heat source units are conducting cooling operations.
Figure 4:
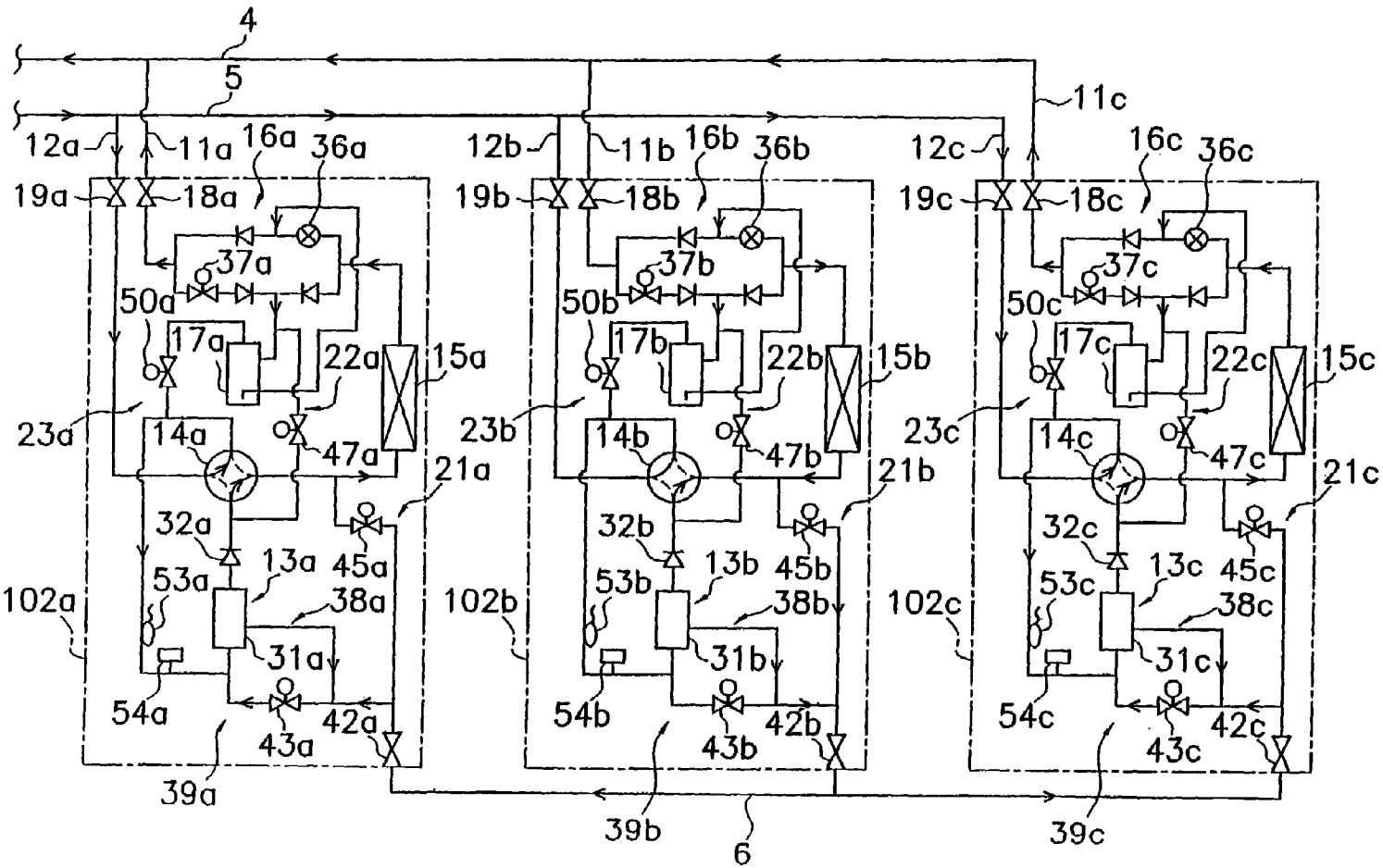
FIG. 4 is an outline of the refrigerant circuits of heat source units when only a portion of a plurality of heat source units are conducting cooling operations, and the other heat source units are stopped.
Figure 5:
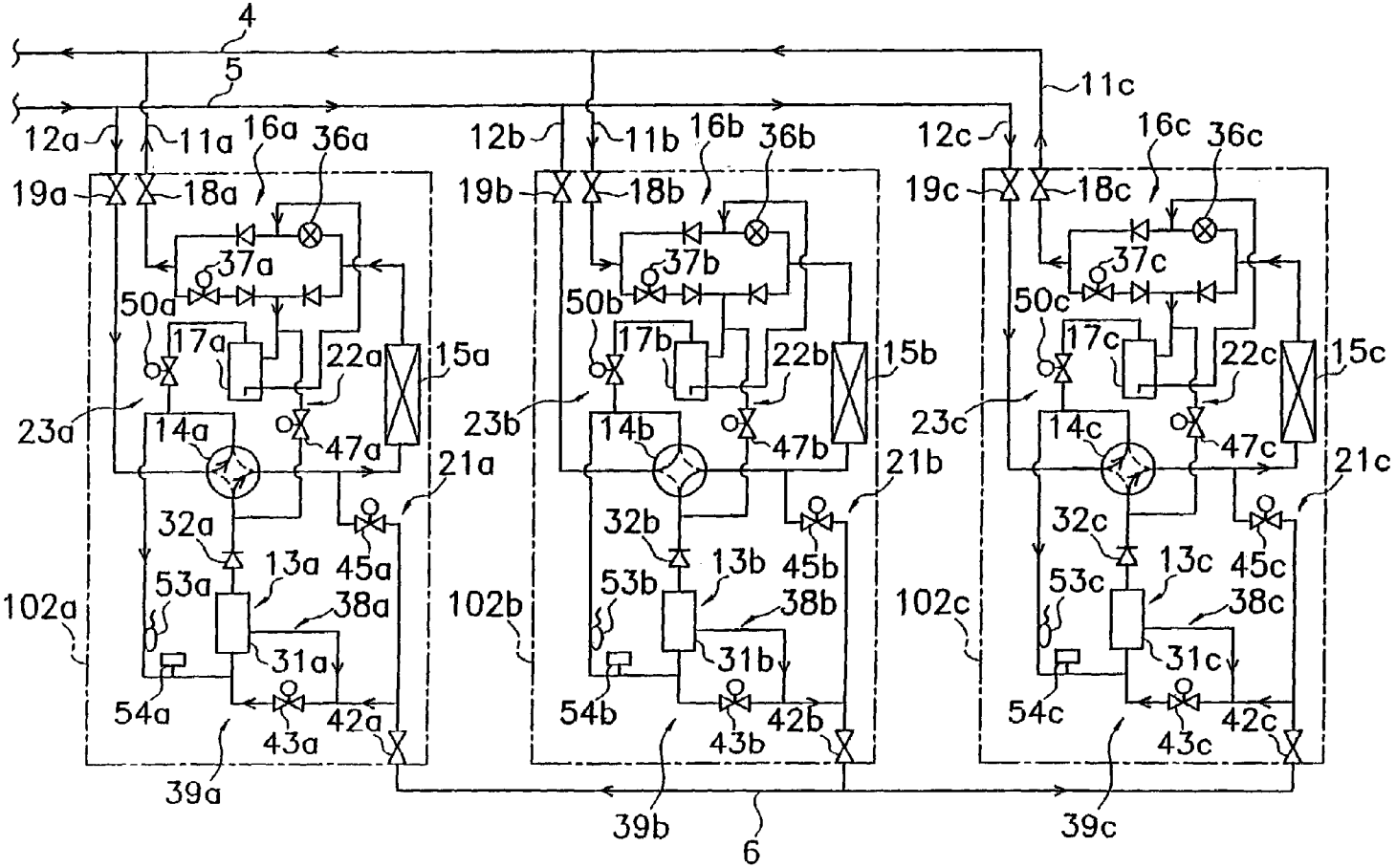
FIG. 5 is an outline of the refrigerant circuits of heat source units when only a portion of a plurality of heat source units are conducting cooling operations, and the other heat source units are stopped.
Figure 6:
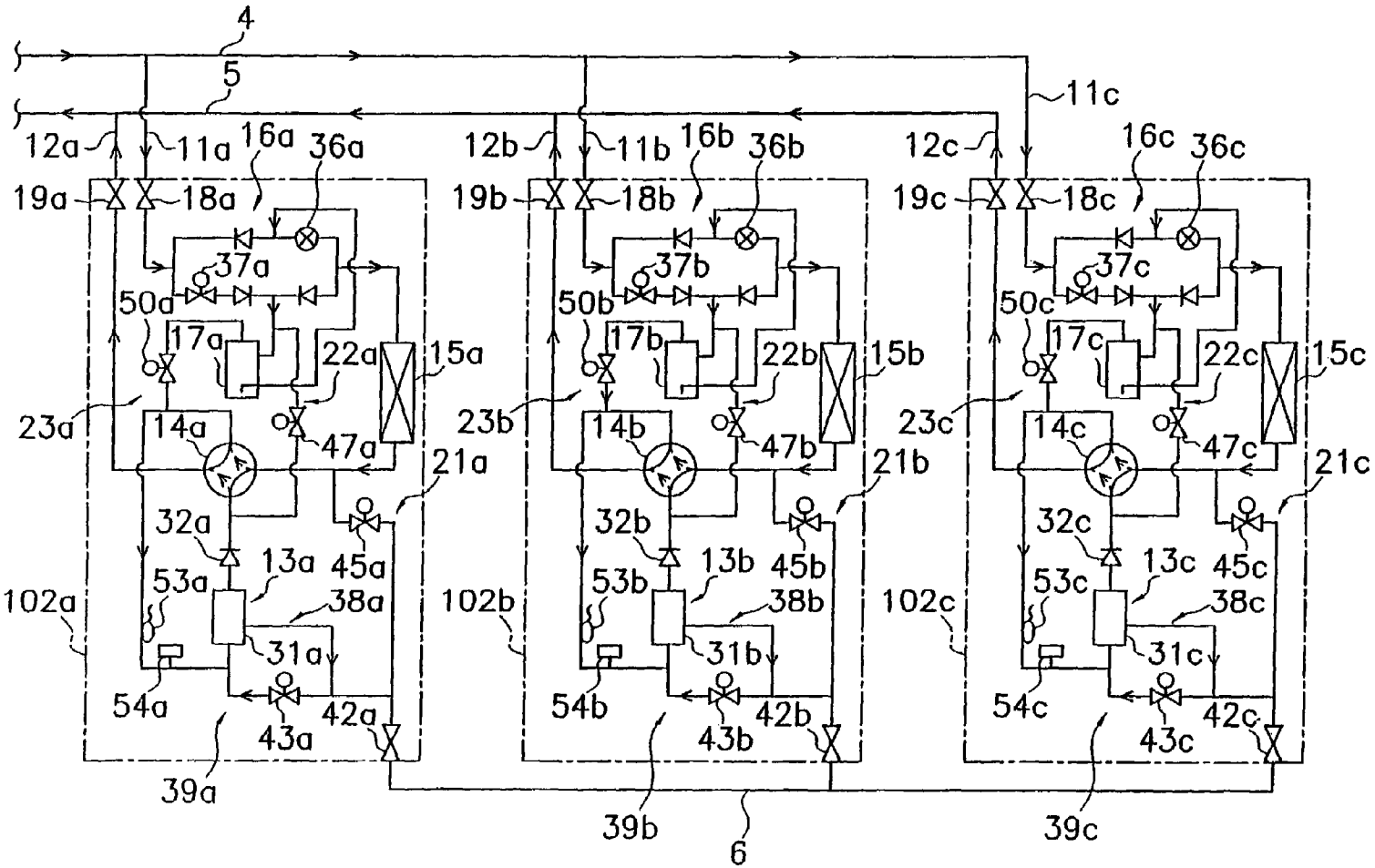
FIG. 6 is an outline of the refrigerant circuits of heat source units when all the heat source units are conducting heating operations.
Figure 7:
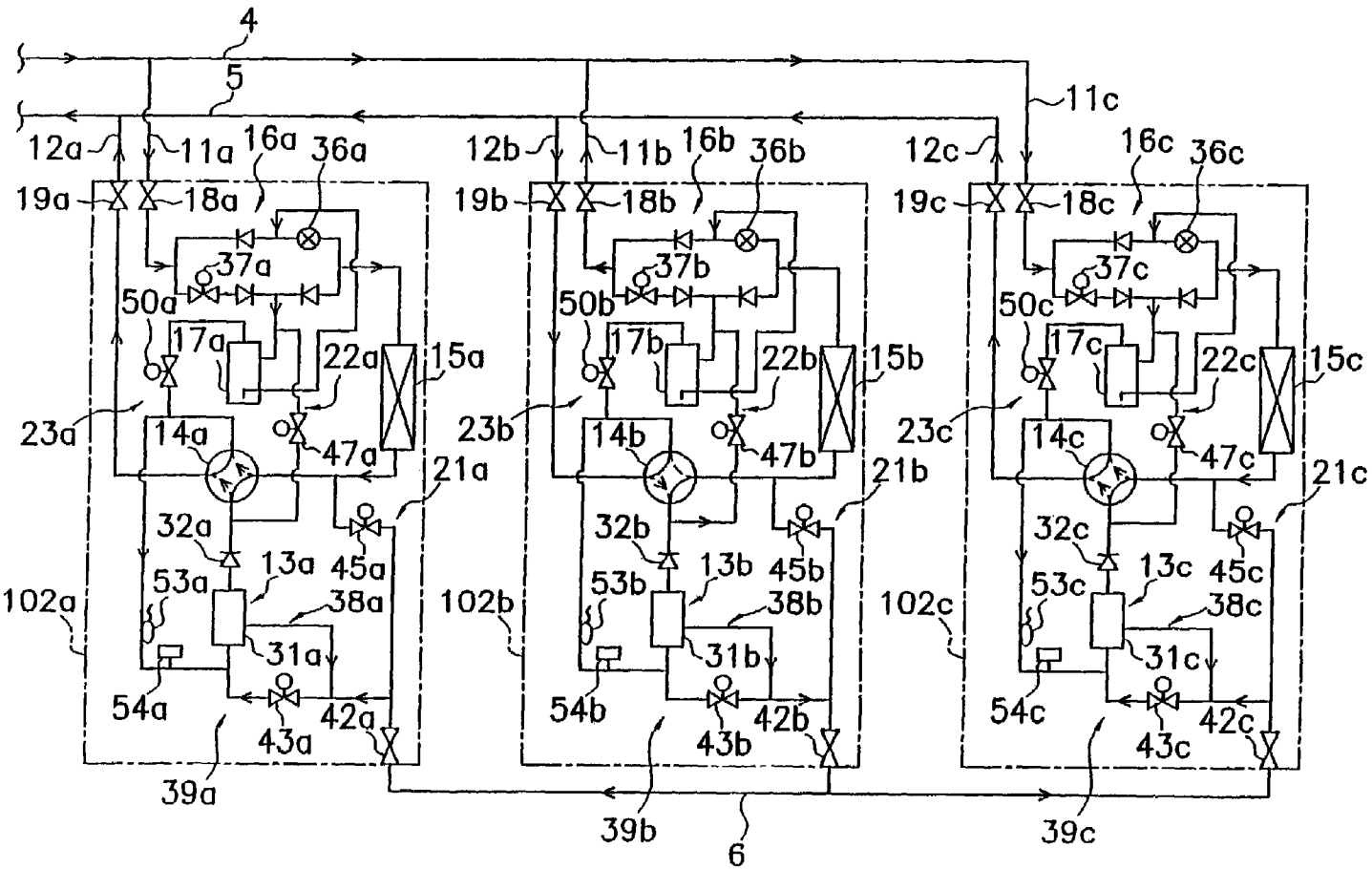
FIG. 7 is an outline of the refrigerant circuits of heat source units when only a portion of a plurality of heat source units are conducting heating operations, and the other heat source units are stopped.
Figure 8:
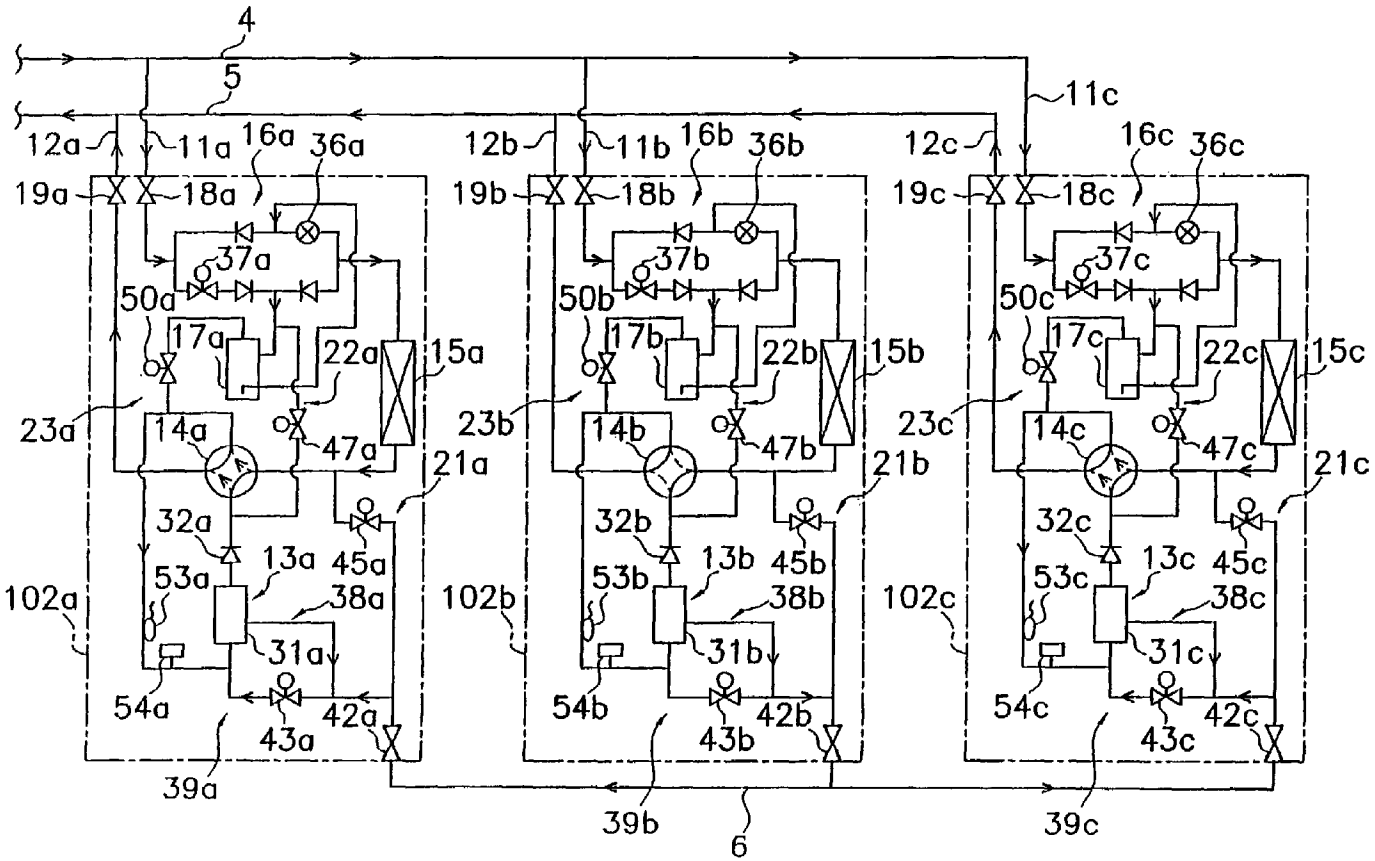
FIG. 8 is an outline of the refrigerant circuits of heat source units when only a portion of a plurality of heat source units are conducting heating operations, and the other heat source units are stopped.

Next, the operation of the air conditioner 1 will be described with reference to FIGS. 3–8. Here, FIG. 3 is an outline of the refrigeration circuits of the heat source units 102a–102c when all of the heat source units 102a–102c are performing cooling operations (the arrows in the figure show the direction of the refrigerant and oil flows). FIGS. 4 and 5 are outlines of the refrigeration circuits of the heat source units 102a–102c when the heat source units 102a, 102c are performing cooling operations and the heat source unit 102b is stopped (the arrows in the figure show the direction of the refrigerant and oil flows). FIG. 6 is an outline of the refrigeration circuits of the heat source units 102a–102c when all of the heat source units 102a–102c are performing heating operations (the arrows in the figure show the direction of the refrigerant and oil flows). FIGS. 7 and 8 are outlines of the refrigeration circuits of the heat source units 102a–102c when the heat source units 102a, 102c are performing heating operations and the heat source unit 102b is stopped (the arrows in the figure show the direction of the refrigerant and oil flows).

1. Cooling Operations (When All Heat Source Units are Operating)

During cooling operations, the four way switching valves 14a–14c of each heat source unit 102a–102c are in the state illustrated by the solid lines in FIG. 3, i.e., the state in which the discharge sides of the compression mechanisms 13a–13c are respectively connected to the gas sides of the heat source side heat exchangers 15a–15c, and the intake sides of the compression mechanisms 13a–13c are respectively connected to the heat source side branch gas lines 12a–12c. In addition, the liquid side gate valves 18a–18c, the gas side gate valve 19a–19c, the oil gate valves 42a–42c, and the first open/close mechanisms 37a–37c of each heat source unit are open. Furthermore, the oil return line 39a is placed into a state in which it can be used, and the refrigerant removal line 21a, the receiver pressurization circuit 22a, and the receiver depressurization circuit 23a are placed into a state in which they will not be used. In other words, the oil return valves 43a–43c are completely open, and the second open/close mechanisms 45a–45c, the third open/close mechanisms 47a-47c, and the fourth open/close mechanisms 50a–50c are closed. In addition, the apertures of the user side expansion valves 61a, 61b of the user units 3a, 3b shown in FIG. 1 are adjusted so that the refrigerant pressure is reduced. The heat source side expansion valve 36a–36c are in the closed state.

With the heat source unit refrigeration circuits in this state, the compression mechanisms 13a–13c of each heat source units 102a–102c begin operating. When this occurs, the high pressure refrigerant gas discharged from each compression mechanism 13a–13c is condensed by each heat source side heat exchanger 15a–15c and becomes refrigerant liquid, and this refrigerant liquid is merged into the refrigerant liquid junction line 4 via the bridge circuits 16a–16c (more specifically the check valves 34a-34c), the receivers 17a–17c, the bridge circuits 16a–16c (more specifically the check valves 35a–35c), and the heat source side branch liquid lines 11a–11c. After that, the pressure of the refrigerant liquid is reduced by the user side expansion valves 61a, 61b of the user unit 3a, 3b, and then the refrigerant liquid is evaporated by the user side heat exchangers 62a, 62b and becomes a low pressure refrigerant gas. This refrigerant gas is branched from the refrigerant gas junction line 5 to each heat source side branch gas line 12a–12c, returns to the compressor mechanisms 13a–13c of each heat source unit 102a–102c, and then repeats this circulation operation.

Note that the oil discharged from the oil accumulation portion of each compression mechanism 13a–13c to, each oil discharge line 38a–38c is returned to the intake side of the compression mechanisms 13a–13c by each oil return line 39a-39c, and is drawn into each compression mechanism 13a–13c together with the low pressure refrigerant.

2. Cooling Operations (When There is a Stopped Heat Source Unit Present)

When the cooling operational burden of the user units 3a, 3b decreases, equipment control will be performed in response to this that reduces the number of operational heat source units 102a–102c. A situation in which only the heat source unit 102*b* is stopped and the other two heat source units 102*a*, 102*c* are operating will be described below with reference to FIGS. 4 and 5.

First, the compression mechanism 13*b* of the heat source unit 102*b* is stopped, and the first open/close mechanism 37*b* and oil return valve 43*b* are closed. When this occurs, the refrigerant pressure from the discharge side of the compression mechanism 13*b* of the heat source unit 102*b* to the heat source side branch liquid line 11*b* will be reduced. At this point, because the first open/close mechanism 37*b* is closed, refrigerant liquid will not flow from the refrigerant liquid junction line 4 into the heat source unit 102*b*. In addition, the oil discharged from the accumulation portion of the compressor 31*a* of the compression mechanism 13*b* to the oil discharge line 38*b* passes through the oil equalization line 6 and the oil return lines 39*a*, 39*c*, and is sent to the intake side of the compression mechanisms 13*a*, 13*c* of the heat source units 102*a*, 102*c*.

If the operation of the heat source units 102*a*, 102*c* continues in this state, refrigerant will be accumulated inside the stopped heat source unit 102*b*, and the quantity of refrigerant that circulates between the user units 3*a*, 3*b* and the operating heat source units 102*a*, 102*c* will be reduced (a refrigerant shortage state). In the air conditioner 1, whether or not a refrigerant shortage state exists can be determined from the refrigerant temperature detected by the temperature sensors 63*a*, 64*a*, 63*b*, 64*b* of the user units 3*a*, 3*b* and the apertures of the user side expansion valves 61*a*, 61*b*. Then, as shown in FIG. 4, if it is determined that a refrigerant shortage state does exist, the refrigerant accumulated between the receiver 17*b* and the check valve 32*b* arranged on the discharge side of the compressor 31*b* of the heat source unit 102*b* passes through the refrigerant removal line 21*a* and the oil equalization line 6 and is supplied to the operating heat source units 102*a*, 102*c* by opening the second open/close mechanism 45*b* of the stopped heat source unit 102*b* for only a predetermined time period. Here, the refrigerant liquid accumulated in the receiver 17*a* of the heat source unit 102*b* is evaporated by the heat source side heat exchanger 15*b*, and then supplied to the intake side of the compression mechanisms 13*a*, 13*c*. Then, this refrigerant gas passes through the oil return lines 39*a*, 39*c* of the heat source units 102*a*, 102*c* and is supplied to the intake side of the compression mechanisms 13*a*, 13*c*. Note that the second open/close mechanism 45*b* will be closed after the expiration of the predetermined time period, but if it is determined after closing the second open/close mechanism 45*b* that the refrigerant shortage state has not been eliminated and that the refrigerant shortage state still exists, the second open/close mechanism 45*b* will be opened again for only the predetermined time period. In this way, the quantity of refrigerant that circulates between the user units 3*a*, 3*b* and the user heat source units 102*a*, 102*c* will be increased and the refrigerant shortage state will be eliminated.

Next, there will be times in which the refrigerant accumulated inside the heat source unit 102*b* will be supplied in excess to the operating heat source units 102*a*, 102*c* and an excessive refrigerant state will be created. As shown in FIG. 5, in this type of situation the second open/close mechanism 45*b* of the stopped heat source unit 102*b* will be closed, and refrigerant will not be discharged from the interior of the heat source unit 102*b*. After that, the refrigerant liquid will be made to flow into the receiver 17*b* from the refrigerant liquid junction line 4 via the heat source side branch line 11*b* by opening the first open/close mechanism 37*b*, and the excessive refrigerant state will be eliminated. Even in this situation, the first open/close mechanism 37*b* is opened for only a predetermined time period and then closed, and will be re-opened for only the predetermined period of time if there is an excessive refrigerant state.

Thus, even when some of the heat source units are stopped by means of equipment control, an appropriate refrigerant circulation quantity can be maintained by opening and closing the first and second open/close mechanisms 37*b*, 45*b* of the stopped heat source unit 102*b*.

3. Heating Operations (When All Heat Source Units are Operating)

During heating operations, the four way switching valves 14*a*–14*c* of each heat source unit 102*a*–102*c* are in the state illustrated by the broken lines in FIG. 6, i.e., the state in which the discharge sides of the compression mechanisms 13*a*–13*c* are respectively connected to the heat source side branch gas lines 12*a*–12*c*, and the intake sides of the compression mechanisms 13*a*–13*c* are respectively connected to the gas sides of the heat source side heat exchangers 15*a*–15*c*. In addition, the liquid side gate valves 18*a*–18*c*, the gas side gate valve 19*a*–19*c*, the oil gate valves 42*a*–42*c*, and the first open/close mechanisms 37*a*–37*c* of each heat source unit are open. Furthermore, the oil return line 39*a* is placed into a state in which it can be used, and the refrigerant removal line 21*a*, the receiver pressurization circuit 22*a*, and the receiver depressurization circuit 23*a* are placed into a state in which they will not be used. In other words, the oil return valves 43*a*–43*c* are completely open, and the second open/close mechanisms 45*a*–45*c*, the third open/close mechanisms 47*a*–47*c*, and the fourth open/close mechanisms 50*a*–50*c* are closed. In addition, the apertures of the user side expansion valves 61*a*, 61*b* of the user unit 3*a*, 3*b* are adjusted in response to the heating burden of the user units 3*a*, 3*b*. The apertures of the heat source side expansion valves 36*a*-36*c* are respectively adjusted based upon the degree of refrigerant gas superheating calculated from the refrigerant temperature and pressure detected by the temperature sensor 53*a* and the pressure sensor 54*a*.

With the heat source unit refrigeration circuits in this state, the compression mechanisms 13*a*–13*c* of each heat source units 102*a*–102*c* begin operating. When this occurs, high pressure refrigerant gas discharged from each compression mechanism 13*a*–13*c* is merged into the refrigerant gas junction line 5 via each heat source side branch gas line 12*a*–12*c*. After that, the refrigerant gas is condensed by the user side heat exchangers 62*a*, 62*b* of the user units 3*a*, 3*b* and becomes refrigerant liquid, and the pressure of the refrigerant liquid is reduced by the user side expansion valves 61*a*, 61*b*. This refrigerant liquid is branched from the refrigerant liquid junction line 4 to each heat source side branch liquid line 11*a*–11*c*, flows through the bridge circuits 16*a*–16*c* (more specifically the first open/close mechanisms 37*a*–37*c* and the check valves 33*a*-33*c*), the receivers 17*a*–17*c*, and the bridge circuits 16*a*–16*c* (more specifically the check valves 36*a*–36*c*), is evaporated by the heat source side heat exchangers 15*a*–15*c* of each heat source side unit 102*a*–102*c*, then returns to the compressor mechanisms 13*a*–13*c*, and then repeats this circulation operation.

Note that the oil discharged from the oil accumulation portion of each compression mechanism 13*a*–13*c* to each oil discharge line 38*a*–38*c* passes through the oil return lines 39*a*–39*c*, is returned to the intake side of the compression mechanisms 13*a*–13*c*, and is drawn into each compression mechanism 13*a*–13*c* together with the low pressure refrigerant gas.

However, during heating operations, when the refrigerant sent from the user side heat exchangers 62*a*, 62*b* of the user unit 3*a*, 3*b* to the heat source units 102*a*–102*c* via the refrigerant liquid junction line 4 is branched from the refrigerant liquid junction line 4 to the heat source side branch liquid lines 11*a*–11*b* of each heat source unit, an unequal flow will often be created because the refrigerant is in the gas-liquid phase. The air conditioner 1 of the present embodiment can operate to eliminate unequal flow when this state is created. The operation of the heat source unit 102*b* when the quantity of refrigerant sent from the refrigerant liquid junction line 4 to the heat source unit 102*b* is less than that sent to the other heat source units 102*a*, 102*c* will be described below.

During heating operations, as noted above, the aperture of the heat source side expansion valve 36*b* is adjusted based upon the degree of refrigerant gas superheating calculated from the refrigerant temperature and pressure detected by the temperature sensor 53*b* and the pressure sensor 54*b*. Because of this, the quantity of refrigerant supplied inside the unit will be reduced, the degree of refrigerant gas superheating will increase, and the aperture of the heat source side expansion valve 36*b* will increase. However, even if the heat source side expansion valve 36*b* is completely open, if the degree of refrigerant gas superheating increases, it will be determined that the quantity of refrigerant supplied inside the unit is insufficient, and the fourth open/close mechanism 50*b* will open for only a predetermined time period. When this occurs, the refrigerant inside the receiver 17*b* will be discharged to the intake side of the compression mechanism 13*b* via the receiver depressurization circuit 23*b*, and the pressure inside the receiver 17*b* will be reduced. In this way, the quantity of refrigerant supplied from the refrigerant liquid junction line 4 to the heat source unit 102*b* will increase. Then, if the time period that the fourth open/close mechanism 50*b* equals the predetermined time period, the degree of refrigerant gas superheating has been reduced, or the heat source side expansion valve 36*b* has begun to close, the fourth open/close mechanism 50*b* will close. By operating the fourth open/close mechanism 50*b* in this way, a refrigerant shortage in the heat source unit 102*b* will be eliminated. Even with the other heat source units 102*a*, 102*c*, the quantity of refrigerant sent from the refrigerant liquid junction line 4 to each heat source unit will be maintained at an appropriate flow rate balance.

4. Heating Operations (When There is a Stopped Heat Source Unit Present)

When the heating operational burden of the user units 3*a*, 3*b* decreases, equipment control will be performed in response to this that reduces the number of heat source units 102*a*–102*c* that operate. A situation in which only the heat source unit 102*b* is stopped and the other two heat source units 102*a*, 102*c* are operating will be described below with reference to FIGS. 7 and 8.

First, the compression mechanism 13*b* of the heat source unit 102 is stopped, and the first open/close mechanism 37*b* and oil return valve 43*b* are closed. At this point, because the first open/close mechanism 37*b* is closed, refrigerant liquid will not flow from the refrigerant liquid junction line 4 into the heat source unit 102*b*. In addition, the oil discharged from the accumulation portion of the compressor 31*a* of the compression mechanism 13*b* to the oil discharge line 38*b* passes through the oil equalization line 6, and is sent to the intake side of the compression mechanisms 13*a*, 13*c* of the heat source units 102*a*, 102*c*.

If the operation of the heat source units 102*a*, 102*c* continues in this state, refrigerant will accumulate inside the stopped heat source unit 102*b*, and the quantity of refrigerant that circulates in the refrigerant circuit will be reduced (a refrigerant shortage state). In the air conditioner 1, whether or not a refrigerant shortage state exists can be determined from the refrigerant temperature detected by the temperature sensors 63*a*, 64*a*, 63*b*, 64*b* of the user units 3*a*, 3*b* and the apertures of the user side expansion valves 61*a*, 61*b*. Then, if it is determined that a refrigerant shortage state exists, the refrigerant accumulated in the stopped heat source unit 102*b* will be supplied to the operating heat source units 102*a*, 102*c*.

Here, the speed with which refrigerant liquid accumulates in the receiver 17*b* may increase immediately after the heat source units conducting heating operations are stopped. If this occurs, like during cooling operations, a sufficient refrigerant discharge speed may not be obtained by simply opening the second open/close mechanism 45*b*. Because of this, as shown in FIG. 7, high pressure refrigerant gas from the refrigerant gas junction line 5 will be supplied to the receiver 17*b* via the heat source side branch gas line 12*b*, the four way switching valve 14*b*, and the receiver pressurization circuit 22*b* by opening the third open/close mechanism 47*b*. When this occurs, the refrigerant liquid inside the receiver 17*b* will be discharged to the exterior of the heat source unit via the heat source side branch liquid line 11*b* because the receiver 17*b* is pressurized and the pressure thereof is higher than the pressure of the refrigerant liquid junction line 4. Thus, the refrigerant shortage state will be eliminated.

Next, the refrigerant accumulated inside the heat source unit 102*b* may be supplied in excess to the operating heat source units 102*a*, 102*c* and thus an excessive refrigerant state will be created. As shown in FIG. 8, in this type of situation the third open/close mechanism 47*b* of the stopped heat source unit 102*b* will be closed, and refrigerant will not be discharged from the interior of the heat source unit 102*b*. After that, the refrigerant liquid will be made to flow into the receiver 17*b* from the refrigerant liquid junction line 4 via the heat source side branch line 11*b* by opening the first open/close mechanism 37*b*, and the excessive refrigerant state will be eliminated.

Thus, even when some of the heat source units are stopped by means of equipment control, an appropriate refrigerant circulation quantity can be maintained by opening and closing the first and third open/close mechanisms 37*b*, 47*b* of the stopped heat source unit 102*b*.

(5) Other Embodiments

Although an embodiment of the present invention was described above based upon the figures, the specific configuration of the present invention is not limited to this embodiment, and can be modified within a range that does not depart from the essence of the invention.

1. Although the heat source units used in the air conditioner in the foregoing embodiment are the air cooling type which use outdoor air as a heat source, water cooling types or ice storage types of heat source units may also be used.

2. Although only one compressor is included in a compression mechanism in the foregoing embodiment, the compression mechanism may include a plurality of compressors.

3. Although in the foregoing embodiment an oil equalization circuit is used to form the refrigerant supply circuit, the oil equalization circuit having an oil removal line and an oil equalization line provided in order to equalize the oil between the compression mechanisms of each heat source unit, a configuration in which a separately provided communication line that communicates between the refrigerant removal line and the intake side of the compression mechanism of each heat source unit may be used in situations in which the oil equalization circuit is a separate circuit structure.

INDUSTRIAL APPLICABILITY

If the present invention is used, the line unit in an air conditioner that includes a plurality of heat source units can be eliminated, and increases in the onsite line construction can be held to a minimum while making it possible to adjust the amount of refrigerant in the air conditioner.

What is claimed is:

1. An air conditioner, comprising:

a plurality of heat source units having compressor mechanisms and heat source side heat exchangers;

a refrigerant liquid junction line and a refrigerant gas junction line that parallel connect each heat source unit;

user units that include user side heat exchangers, the user units connected to the refrigerant liquid junction line and the refrigerant gas junction line; and a refrigerant supply circuit used in situations in which some of the plurality of heat source units stop operating in response to an operational burden of the user units, the refrigerant supply circuit including refrigerant removal lines provided in each heat source unit that serve to remove refrigerant that accumulates inside stopped heat source units to the exterior thereof, and a communication line that connects the refrigerant removal lines and intake sides of the compression mechanisms of operating heat source units.

2. The air conditioner disclosed in claim 1, wherein the heat source side heat exchangers are connected to discharge sides of the compression mechanisms; and each heat source unit further includes a heat source side branch liquid line (11*a*–11*c*) that is connected to a liquid side of the heat source side heat exchanger and the refrigerant liquid junction line, a receiver that is provided on the heat source side branch liquid line, and a heat source side branch gas line that is connected to the intake side of the compression mechanism and a refrigerant gas junction line;

wherein the refrigerant removal lines are arranged such that they remove refrigerant from between the discharge sides of the compression mechanisms and gas sides of the heat source side heat exchangers.

3. The air conditioner disclosed in claim 2, wherein the heat source side branch liquid lines include refrigerant open/close mechanisms that close so that refrigerant will not flow from the refrigerant liquid junction line to the inside of stopped heat source units when accumulated refrigerant inside stopped heat source units is to be removed to the exterior thereof via the refrigerant removal lines.

4. The air conditioner disclosed in claim 3, wherein the refrigerant open/close mechanisms can make refrigerant liquid that flows in the refrigerant liquid junction line flow into stopped heat source units when a quantity of refrigerant that flows between the user units and the operating heat source units reaches an excessive state.

5. The air conditioner disclosed in claim 1, wherein the heat source side heat exchangers are connected to discharge sides of the compression mechanisms; and each heat source unit further includes a heat source side branch liquid line that is connected to a liquid side of the heat source side heat exchanger and the refrigerant liquid junction line, a heat source side branch gas line that is connected to the discharge side of the compression mechanism and a refrigerant gas junction line, and a receiver that is provided on the heat source side branch liquid line;

wherein the refrigerant removal lines are arranged such that they remove refrigerant from between the intake sides of the compression mechanisms and gas sides of the heat source side heat exchangers.

6. The air conditioner disclosed in claim 5, wherein the heat source side branch liquid lines include refrigerant open/close mechanisms that close so that refrigerant will not flow from the refrigerant liquid junction line to the inside of stopped heat source units when accumulated refrigerant inside stopped heat source units is to be removed to the exterior thereof via the refrigerant removal lines.

7. The air conditioner disclosed in claim 6, wherein stopped heat source units further include receiver pressurization circuits that make some of the refrigerant that flows in the refrigerant gas junction line flow into the receivers via the heat source side branch gas lines.

8. The air conditioner disclosed in claim 6, wherein the refrigerant open/close mechanisms can make refrigerant liquid that flows in the refrigerant liquid junction line flow into stopped heat source units when a quantity of refrigerant that flows between the user units and the operating heat source units reaches an excessive state.

9. The air conditioner disclosed in claim 1, wherein the communication line is an oil equalization line that equally distributes oil between the compression mechanisms of each heat source unit.

10. An air conditioner, comprising: a plurality of heat source units that include compression mechanisms, heat source side heat exchangers connected to intake sides of the compression mechanisms, and receivers that are connected to liquid sides of the heat source side heat exchangers;

a refrigerant liquid junction line and a refrigerant gas junction line that parallel connect each heat source unit;

user units that include user side heat exchangers, the user units connected to the refrigerant liquid junction line and the refrigerant gas junction line; and receiver depressurization circuits that make refrigerant flow out from the receivers of the heat source units that have a shortage of refrigerant to the intake sides of the compression mechanisms thereof.

* * * * *